United States Patent [19]

Seward

[11] Patent Number: 4,818,544

[45] Date of Patent: Apr. 4, 1989

[54] BEVERAGE PACKAGES

[75] Inventor: Barry Seward, Lymington Bottom, England

[73] Assignee: Mars G. B. Limited, London, England

[21] Appl. No.: 54,301

[22] Filed: May 26, 1987

[30] Foreign Application Priority Data

May 27, 1986 [GB] United Kingdom ..... 8612868

[51] Int. Cl.[4] ..... B65D 30/24; B65D 30/10; B65D 33/36

[52] U.S. Cl. ..... 426/77; 99/295; 426/81; 426/82; 426/115; 206/0.5; 383/67; 383/94; 383/103; 383/108; 383/904; 222/541

[58] Field of Search ..... 426/77-84, 426/112, 115, 113, 394, 433, 124; 99/295, 296, 287, 289 R, 289 T, 316, 317, 323, 319, 321, 281, 302 R; 222/129.1, 541; 206/5; 383/80, 21, 93, 94, 904, 102, 103, 119, 104; 210/282, 484

[56] References Cited

U.S. PATENT DOCUMENTS

| | | | |
|---|---|---|---|
| 2,137,243 | 11/1938 | Heyman | 426/78 |
| 2,292,101 | 8/1942 | Brown . | |
| 2,328,018 | 8/1943 | Irmscher | 426/81 |
| 2,652,336 | 9/1953 | Hensgen et al. | 426/112 |
| 2,687,158 | 8/1954 | Owen | 383/80 |
| 2,756,154 | 7/1956 | Mahaffy | 426/106 |
| 2,778,739 | 1/1957 | Rodth . | |
| 2,783,704 | 3/1957 | Liebelt . | |
| 2,905,075 | 9/1959 | Liebelt . | |
| 2,935,929 | 5/1960 | Di Cara | 99/289 T |
| 2,968,560 | 1/1961 | Goros | 99/295 |
| 3,030,874 | 4/1962 | Fiori | 99/295 |
| 3,083,101 | 3/1963 | Noury . | |
| 3,087,491 | 4/1963 | Geweckeet et al. | 383/21 |
| 3,165,114 | 1/1965 | Garrett | 383/904 |
| 3,199,437 | 8/1965 | Nelsen | 99/295 |
| 3,244,586 | 12/1965 | Wade . | |
| 3,292,527 | 12/1966 | Stasse | 426/115 |
| 3,344,734 | 10/1967 | Aguirre-Batress et al. . | |
| 3,346,388 | 10/1967 | Andrews et al. | 426/82 |
| 3,347,151 | 10/1967 | Ronalds | 426/77 |
| 3,352,226 | 11/1967 | Nelsen | 426/79 |
| 3,372,634 | 3/1968 | Brinkman et al. | 99/295 |
| 3,387,553 | 6/1968 | Tavera . | |
| 3,483,812 | 12/1969 | Gast et al. . | |
| 3,499,578 | 3/1970 | Oneal | 426/115 |
| 3,554,256 | 1/1971 | Anderson | 383/80 |
| 3,589,272 | 6/1971 | Bouladon | 99/295 |
| 3,607,297 | 3/1971 | Fasand et al. | 426/433 |
| 3,615,708 | 10/1971 | Abile-Gal | 426/77 |
| 3,647,386 | 3/1972 | Gilford | 383/93 |
| 3,812,273 | 5/1974 | Schmidt . | |
| 3,833,409 | 9/1974 | Schmidt . | |
| 3,928,045 | 12/1975 | Tsunoda et al. | 426/113 |
| 3,935,318 | 1/1976 | Mihailide | 426/80 |
| 3,963,026 | 6/1976 | Herb | 383/80 |
| 4,007,674 | 2/1977 | Lichowsky | 99/289 R |
| 4,046,276 | 9/1977 | Winchell et al. | 383/80 |
| 4,126,167 | 11/1978 | Smith et al. | 383/80 |
| 4,136,202 | 1/1979 | Favre | 426/77 |
| 4,257,535 | 3/1981 | Mellett | 222/92 |
| 4,278,691 | 7/1981 | Donarumma et al. | 426/80 |
| 4,399,158 | 8/1983 | Bardsley et al. | 426/115 |
| 4,410,550 | 10/1983 | Gaskill | 426/77 |
| 4,415,085 | 11/1983 | Clarke et al. | 206/526 |

FOREIGN PATENT DOCUMENTS

| | | | |
|---|---|---|---|
| 1947146 | 12/1971 | Fed. Rep. of Germany | 99/295 |
| 2258462 | 6/1974 | Fed. Rep. of Germany | 426/112 |
| 2264208 | 7/1974 | Fed. Rep. of Germany | 426/77 |
| 2500131 | 7/1976 | Fed. Rep. of Germany | 426/78 |
| 2228374 | 11/1974 | France . | |
| W08300611 | 3/1983 | Japan | 99/295 |
| 1180059 | 2/1970 | United Kingdom | 426/115 |
| 2121762 | 1/1984 | United Kingdom | 426/77 |

*Primary Examiner*—Steven Weinstein
*Attorney, Agent, or Firm*—Curtis, Morris & Safford

[57] ABSTRACT

A beverage sachet has improved base seam opening performance by the provision of sealed lands extending inwardly from the side seams.

4 Claims, 1 Drawing Sheet

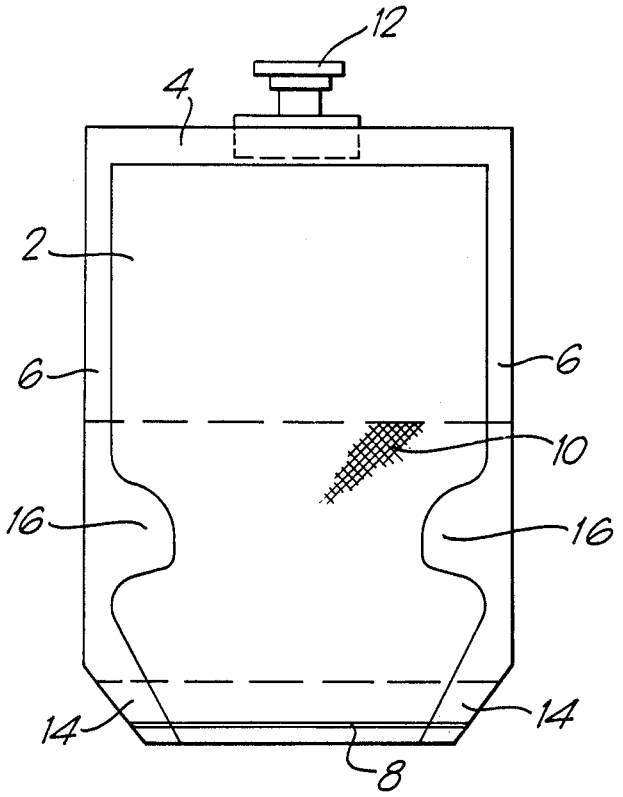
12
4
2
6
6
10
16
16
14
14
8

BEVERAGE PACKAGES

This invention relates to beverage packages.

In U.k. Patent Specification No. 2121762A published Jan. 4, 1984 we described a system for obtaining beverages from, inter alia, sealed sachets containing a product providing a beverage when mixed with water, for example ground coffee or leaf tea. An application corresponding to U.K. Specification No. 2121762A was filed in the United States as Ser. No. 491,561 on May 4, 1983, the disclosure of which application is incorporated herein by reference. The sachet contains a filter material to retain the coffee grounds or tea leaves and preferably is provided with a plastics nozzle at the top to assist in locating the sachet correctly with a water-introduction injector. The base of the sachet is opened, for example, by cutting or by the provision of a pressure- or heat-sensitive seal, an aqueous medium is introduced through the nozzle, and the beverage is collected from the opening in the sachet base.

One problem with such sachets arises from irregular base openings. In our European Specification No. 0179641A published Apr. 30, 1986 we have described and claimed how base openings may be improved by use of a web of material within the sachet (which web may or may not be a filter mesh) and which is provided with an upwardly-facing seam which tends to evert when aqueous medium is introduced at the top of the sachet. An application corresponding to European Specification No. 01796441A was filed in the United States as Ser. No. 787,808 on Oct. 16, 1985, the disclosure of which application is incorporated herein by reference.

There is, however, still room for improvement with base openings. One problem which may still arise results from the center of the base seam curling upwards as it opens. If this curl stays in place, there is the possibility of it acting as a channel to enable liquid to spurt out obliquely rather than purely vertically downwards. We have now found that by providing sealed lands on the side seams adjacent the base this problem can be reduced or eliminated.

According to the invention we provide a generally planar sealed beverage sachet formed of a substantially air- and water-impermeable flexible sheet material, said sheet material enclosing and being attached to a web of permeable material which supports a product which provides a beverage when mixed with an aqueous medium, the sachet being provided with a locating means at one end thereof (the top end) for an aqueous medium introducing means, a frangible base seam at the opposite end to the top end, and a pair of side seams each of which includes, adjacent the base seam, a sealed land, said lands extending inwardly towards one another across the generally planar surface of the sachet.

Preferably the sachet has an everting permeable web one which, in cross section, includes an inverted generally V-shaped portion, with the opposed edges of the web being attached to respective opposite faces of the air- and water-impermeable sheet material.

The lands may be roughly semicircular in shape and may be disposed adjacent the web material (typically a filter material) within the sachet.

BRIEF DESCRIPTION OF THE DRAWING

A preferred sachet according to the invention is illustrated in the accompanying drawing which shows a front elevation of the sachet.

Referring to the drawing, the sachet is generally of the type described in European Specification No. 0179641A and consists of two sheets of water- and air-impermeable sheet material 2 welded together at top seam 4 and side seam 6. As disclosed in European Specification No. 0179641A, and corresponding U.S. Application Ser. No. 787,808, filed Oct. 16, 1985, which disclosure is incorporated herein, the base seam 8 may be formed of a heat- or pressure-sensitive seal which is broken when a fluid medium such as air or water is forced into the sachet. Preferably, bottom seam 8 is formed of a pressure-sensitive adhesive. Within the sachet, sealed to the side seams, is a sheet of filter material 10 folded to form a W in cross-section. The apex of the W everts when the sachet is opened. A nozzle 12 is sealed into top seam 4.

The side seams 6 extend vertically downwardly and then taper inwardly at 14 to form a narrower opening for the beverage. Adjacent the taper, each side seam 6 includes a sealed land 16. As shown each land extends inwardly to approximately the same extent as the taper on each seam.

When the sachet is used, the presence of the lands 16 have a tendency to cause the side seams to bend inwards and reduce the bottom seam curling tendency described above. The lands generally provide a more consistent and better opening of the sachet when used.

I claim:

1. A generally planar sealed beverage sachet formed of a substantially air- and water-impermeable flexible sheet material, said sheet material enclosing and being attached to a web of water permeable material which supports a product which provides a beverage when mixed with an aqueous medium, the sachet being provided with a locating means at one end thereof for an aqueous medium introducing means, a frangible base seam comprising a pressure- or heat-sensitive seal at the opposite end, and a pair of side seams each of which includes, adjacent the base seam, a sealed land, said lands extending inwardly towards one another across the generally planar surface of the sachet, said lands being configured and oriented within said sachet sufficient to reduce upward curling of the base seam when aqueous medium is introduced and said base seam opens when said sachet is used.

2. A sachet according to claim 1 wherein the side seams taper inwardly towards the base seam of the sachet, each land being disposed at the top of the taper and extending inwardly to approximately the same extent as the taper.

3. A sachet according to claims 1 or 2 wherein the locating means comprises a plastic nozzle attached to the sachet.

4. A sachet according to claims 1 or 2 wherein the product is ground coffee or leaf tea and the web material forms a filter therefor.

* * * * *